United States Patent [19]

Tasson et al.

[11] Patent Number: 4,846,069

[45] Date of Patent: Jul. 11, 1989

[54] CASED TELESCOPED AMMUNITION HAVING FEATURES AUGMENTING CARTRIDGE CASE END CAP RETENTION AND RETRACTION

[75] Inventors: Brian B. Tasson, Anoka; J. Bruce Warren, Wayzata, both of Minn.

[73] Assignee: Honeywell Inc., Minneapolis, Minn.

[21] Appl. No.: 154,564

[22] Filed: Feb. 10, 1988

[51] Int. Cl.[4] ..... F42B 5/02

[52] U.S. Cl. ..... 102/434; 102/430; 102/464; 102/469

[58] Field of Search ..... 102/433, 434, 430, 443, 102/464, 467, 469, 470

[56] References Cited

U.S. PATENT DOCUMENTS

| | | | |
|---|---|---|---|
| 300,449 | 6/1884 | Dickey . | |
| 331,511 | 12/1885 | Lorenz . | |
| 546,936 | 9/1895 | Pinfold . | |
| 702,208 | 6/1902 | Hayner . | |
| 1,062,604 | 5/1913 | Pedersen . | |
| 1,079,083 | 11/1913 | Wesson . | |
| 1,094,565 | 4/1914 | Hoagland . | |
| 1,974,270 | 9/1934 | Guignet | 102/12 |
| 2,349,970 | 5/1944 | Lambeek | 102/43 |
| 2,402,068 | 6/1946 | Meador | 148/12 |
| 2,535,624 | 12/1950 | Burney | 102/38 |
| 2,568,080 | 9/1951 | McGahey, Jr. | 102/38 |
| 2,853,945 | 9/1958 | Stealey | 102/44 |
| 2,866,412 | 12/1958 | Meyer et al. | 102/38 |
| 2,920,565 | 1/1960 | Heidmann | 102/43 |
| 2,938,458 | 5/1960 | O'Brien | 102/38 |
| 2,996,988 | 8/1961 | Kunz | 102/38 |
| 3,009,394 | 11/1961 | Kamp et al. | 102/434 |
| 3,279,373 | 10/1966 | Stadler et al. | 102/44 |
| 3,568,599 | 3/1971 | Dardick | 102/38 |
| 3,590,740 | 7/1971 | Herter | 102/44 |
| 3,761,322 | 9/1973 | Winter et al. | 148/11.5 A |
| 3,948,178 | 4/1976 | Luther et al. | 102/43 R |
| 4,000,697 | 1/1977 | Levine | 102/38 |
| 4,197,801 | 4/1980 | LaFever et al. | 102/38 CC |
| 4,202,270 | 5/1980 | Luther et al. | 102/43 R |
| 4,220,089 | 9/1980 | Smith | 102/38 R |
| 4,335,657 | 6/1982 | Bains | 102/433 |
| 4,604,954 | 8/1986 | Clarke et al. | 102/434 |

*Primary Examiner*—Harold J. Tudor
*Attorney, Agent, or Firm*—Roger W. Jenson

[57] ABSTRACT

An improved cased telescoped ammunition round includes a propellant charge disposed in a tubular case and having an axial bore. The case is composed of a skin tube and forward and aft end caps on opposite ends of the tube. The case defines a chamber that contains the propellant charge. Separate forward and aft tubes are disposed in the case extending at least partially through the axial bore of the propellant charge from respective forward and aft ends of the bore. The separate tubes are attached respectively to the forward and aft end caps of the case. A projectile is housed within the separate tubes and the axial bore of the propellant charge, and a primer is disposed within an aft end of the aft tube. The primer is actuatable for igniting the propellant charge to cause firing of the projectile forwardly from the case. Internal spider-like flexure springs having slightly different configurations are associated with the forward and aft ends of the separate tubes adjacent the forward and aft end caps and with the opposite ends of the case skin tube. The flexure springs are capable of resiliently and yieldably flexing to provide positive end cap retention during round firing and end cap retraction after firing to ensure dimensional recovery of the case after firing of the projectile so that the case can be ejected from a gun chamber.

22 Claims, 4 Drawing Sheets

CASED TELESCOPED AMMUNITION HAVING FEATURES AUGMENTING CARTRIDGE CASE END CAP RETENTION AND RETRACTION

CROSS REFERENCE TO RELATED APPLICATIONS

Reference is hereby made to the following copending U.S. applications dealing with related subject matter and assigned to the same assignee of the present invention:

1. "Cased Telescoped Ammunition Having Features Augmenting Cartridge Case Dimensional Recovery by Center Sleeve" by W. Martwick et al, assigned U.S. Ser. No. 154,416 and filed Feb. 10, 1988.

2. "Cased Telescoped Ammunition Having Features Augmenting Cartridge Case Dimensional Recovery By Case Skin Tube" by W. Martwick, assigned U.S. Ser. No. 154,560 and filed Feb. 10, 1988.

BACKGROUND OF THE INVENTION

1. Field of the Invention

The present invention generally relates to cased telescoped ammunition and, more particularly, is concerned with features for augmenting retention and retraction of cartridge case end caps of the ammunition round.

2. Description of the Prior Art

Cased telescoped ammunition is generally well-known. Representative prior art versions of such ammunition are disclosed in U.S. patents to Meyer et al (U.S. Pat. No. 2,866,412), Kunz (U.S. Pat. No. 2,996,988), LaFever et al (U.S. Pat. No. 4,197,801), Smith (U.S. Pat. No. 4,220,089), Bains (U.S. Pat. No. 4,335,657) and Clarke et al (U.S. Pat. No. 4,604,954).

Typically, a round of cased telescoped ammunition includes an elongated cylindrical case defining a chamber that contains a propellant charge. The propellant charge has an axial bore through which extends a central tube in coaxial relation with the case and fastened at its opposite ends to the opposite ends of the case. A telescoped projectile is housed within a forward portion of the central tube, whereas an aft portion of the central tube, referred to as a control section, receives a piston or spud on the aft end of the projectile. A primer is positioned within the control section aft of the projectile spud, and a small amount of propellant is contained therein between the primer and the spud.

The round of ammunition is loaded in a gun chamber located rearwardly of the gun barrel. When the round is fired, the primer ignites the small amount of propellant in the control section. The resulting gas applies a force against the spud, driving the projectile forwardly out of the central tube and into the gun barrel. Next, the hot gas ignites the main propellant charge surrounding the projectile. Burning of the propellant charge produces gas at much higher pressure which drives the projectile through the gun barrel to exit the muzzle at high velocity.

The increasing pressure created by the burning propellant charge expands the ammunition case axially and radially. The pressure also acts to elastically deform the gun, enlarging the chamber.

Then, when the pressure is relieved by exit of the projectile from the gun barrel, the gun chamber reverts to its unpressurized dimensions. In order to extract the case from the gun chamber, it is necessary that the case return or recover at least to dimensions which allow clearance between it and the ends and interior surface of the chamber.

It is seen, therefore, that the ammunition cartridge case must expand axially and radially during firing to accommodate the structural response of the gun chamber to gun gas pressure. Such cartridge cases are fitted with end caps which seal the chamber to prevent escape of high pressure gun gas. In addition to sealing the chamber during firing, the end caps must be retained by the cylindrical skin tube of the case and must not retard the axial shrinkage of the gun chamber after firing. Retardation would slow the gun and separation of an end cap from the first case of the ammunition round could cause a gun stoppage.

Therefore, it is essential that features be incorporated in the ammunition round which will ensure that effective end cap retention and retraction take place.

SUMMARY OF THE INVENTION

The present invention provides cased telescoped ammunition designed to achieve the aforementioned objectives. The present invention encompasses several different features associated with the end caps and case skin tube of a round of cased telescoped ammunition for augmenting retention and retraction of the end caps. Some of these features are advantageously incorporated together to realize significantly improved results; however, improvement of end cap retention and retraction can be obtained by employment of the features separately from or as alternatives to one another.

The cased telescoped ammunition round in which the features of the present invention are employed comprises the combination of: (a) an elongated propellant charge having an axial bore therethrough; (b) an elongated tubular case composed of a skin tube and forward and aft end caps on opposite forward and aft ends of the tube, the case defining a chamber that contains the propellant charge; (c) tubular means disposed in the case extending at least partially through the axial bore of the propellant charge from forward and aft ends thereof and attached respectively to the forward and aft end caps of the case; (d) a projectile housed within the tubular means and in the axial bore of the propellant charge; and (e) a primer positioned within the aft end of the tubular means and being actuatable for igniting the propellant charge to cause firing of the projectile forwardly from the case.

The features of the present invention generally relate to internal spider-like flexure springs having slightly different configurations and being associated with the forward and aft ends of the tubular means adjacent the forward and aft end caps and with the opposite ends of the case skin tube. The flexure springs can resiliently and yieldably flex to provide positive end cap retention during cartridge firing and effective end cap retraction after firing to ensure dimensional recovery of the tubular case after firing of the projectile so that the case can be ejected from a gun chamber.

More particularly, the spider-like flexure springs have respective peripherl annular ring-like base portions attached by suitable fastening means, such as circumferentially spaced apart rivets, at the interior of the respective forward and aft rims or ends of the case skin tube. The springs also have respective pluralities of spring finger portions connected to the respective base portions and projecting radially inwardly therefrom which, at inner tips thereof, are anchored to respective forward and aft ends of the tubular means.

The advantage of this approach to end cap retention over others is that the end caps are more rigidly retained. In addition, if the case skin tube gets crushed circumferentially, the end caps will still be retained. The end caps are also easier and cheaper to fabricate with this approach because recesses to accept the case dimples are not required.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Prior Art Cased Telescoped Ammunition

Figure 1:
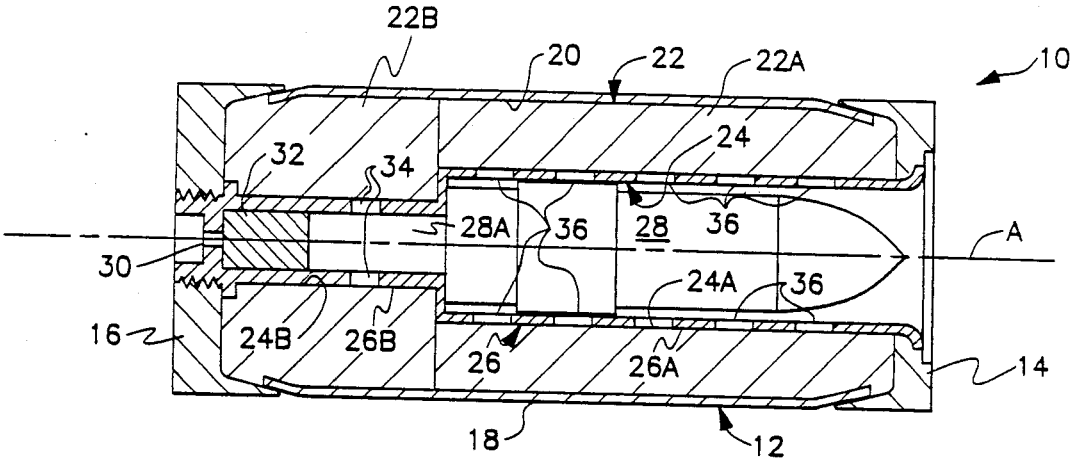
Fig. 1 (PRIOR ART)
FIG. 1 is a longitudinal axial sectional view of a prior art cased telescoped ammunition round.
Figure 2:
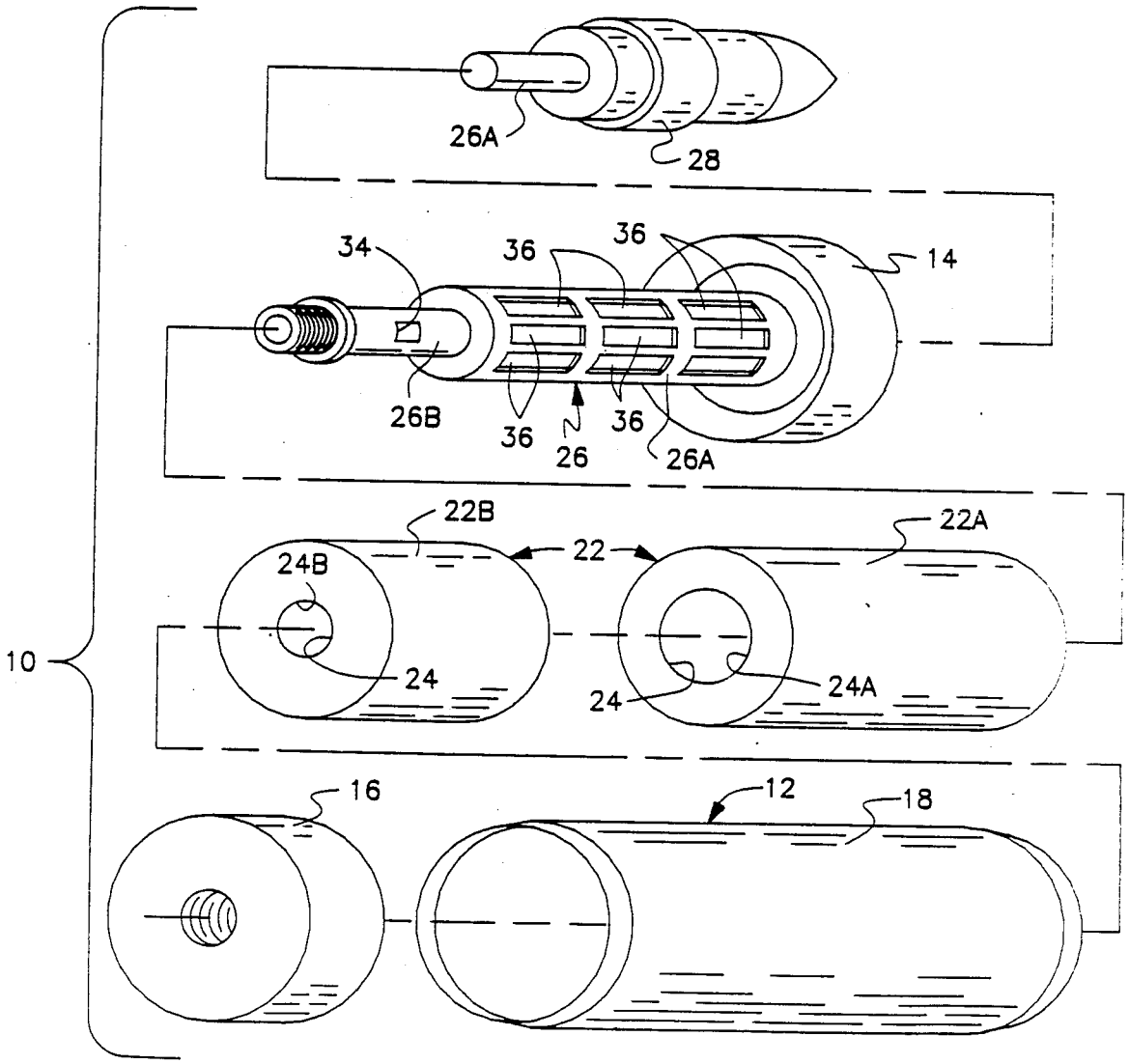
Fig. 2 (PRIOR ART)
FIG. 2 is an exploded perspective view of the prior art round of FIG. 1.

Referring now to FIGS. 1 and 2 of the drawings, there is shown a prior art round of cased telescoped ammunition, generally designated by the numeral 10. The ammunition round 10 includes an elongated cylindrical case 12 composed of a pair of forward and aft end seals or caps 14, 16 sealed on opposite ends of a skin tube 18. The case 12 defines a chamber 20 that contains a propellant charge 22 composed of forward and aft portions 22A, 22B. The propellant charge 22 has an axial bore 24 (composed of corresponding forward and aft portions 24A, 24B) through which extends a center sleeve 26 in coaxial relation with the case 12. The center sleeve 26 is fastened at its opposite ends to the end caps 14, 16.

A tapered or telescoped projectile 28 is housed within a forward end portion 26A of the center sleeve 26. An aft end portion of the center sleeve 26, referred to as a control tube 26B, has a substantially smaller diameter size and is shorter in length than the forward end portion 26A thereof. The projectile 28 incorporates a short piston or spud 28A of reduced diameter on its aft end which extends in a close fitting relation into the control tube 26B of the center sleeve 26. A primer 30 is also positioned within the control tube 26B aft of the projectile spud 28A and a small amount of propellant 32 is contained in the control tube 26B between the primer 30 and the projectile spud 28A. Windows or vents 34, 36 are respectively formed through the aft end portion or control tube 26B and the forward end portion 26A of the center sleeve 26.

In operation, the primer 30 is fired initiating the small amount of propellant 32 in the control tube 26B aft of the projectile spud 28A. Expansion of the resulting gas generated by the initiated propellant 32 applies an increasing force against the spud 28A, driving the projectile 28 forward out of the centersleeve 28 and into the rear end of a gun barrel. As the end of the projectile spud 28A moves forward in the control tube 26B of the center sleeve 26, it exposes the vents 34 therein and thereafter the vents 36 in the forward end portion of the center sleeve 26. The hot gas generated by the initiated propellant 32 then ignites the main propellant charge 22 surrounding the projectile 28. Burning of the propellant charge 22 produces gas at much higher pressure which drives the projectile through the gun barrel to exit the muzzle at high velocity.

The increasing pressure created by the burning propellant charge 22 elongates the case skin tube 18 and forces the end caps 14, 16 apart to the point where they are constrained by the opposite ends of a gun chamber (not shown) which houses the ammunition round 10. The pressure also forces the case skin tube 18 radially outward into intimate contact with the cylindrical interior surface of the gun chamber. After intimate contact has been achieved, the pressure continues to increase and act to elastically deform the gun, enlarging the chamber and forcing apart the ends thereof.

When the pressure is relieved by the exit of the projectile from the muzzle of the barrel, the gun chamber reverts to its unpressurized dimensions. In order to extract the case 12 from the cylindrical gun chamber, it is necessary that the case 12 return or recover at least to dimensions which allow clearance between the end caps 14, 16 of the case 12 and the opposite breech and barrel faces or ends of the chamber as well as radially between the case 12 and interior cylindrical surface of the chamber. It is essential that features be incorporated in the ammunition which will ensure that such dimensional recovery takes place. These features which are the subject of the present invention will now be described in detail.

Features of the Present Invention

Figure 3:
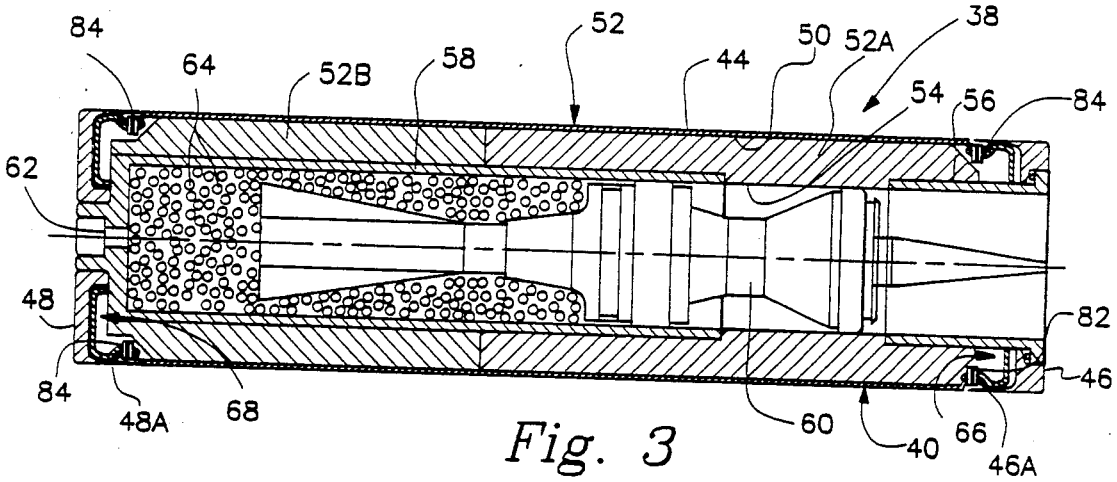
FIG. 3 is a longitudinal axial sectional view of a cased telescoped ammunition round incorporating the features of the present invention for achieving retention and retraction of the case end caps, with the initial relaxed condition of the round before firing being illustrated.
Figure 4:
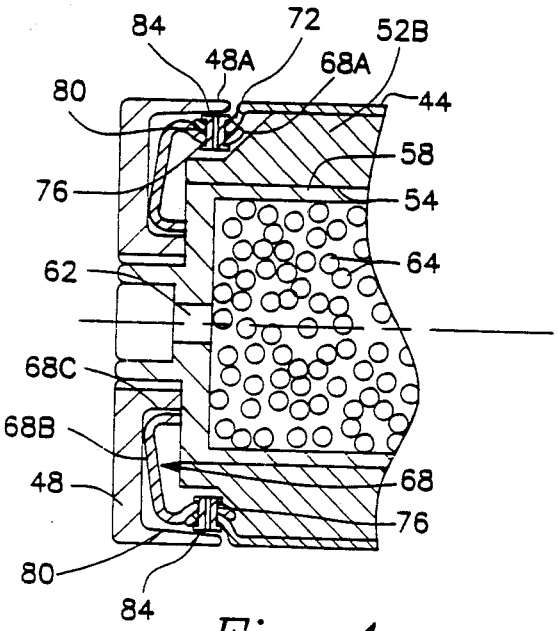
FIG. 4 is an enlarged fragmentary view of the rearward end of the round of FIG. 3, showing the initial unflexed condition of one of the end cap retention and retraction features before firing of the round.
Figure 5:
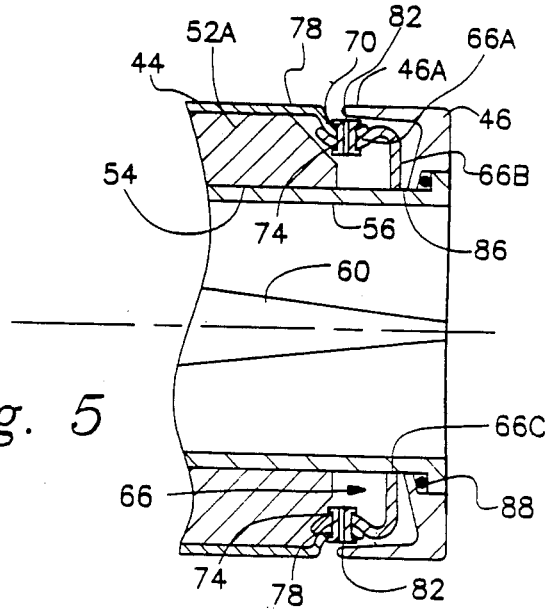
FIG. 5 is an enlarged fragmentary view of the forward end of the round of FIG. 3, showing the initial unflexed condition of the other of the end cap retention and retraction features before firing of the round.
Figure 7:
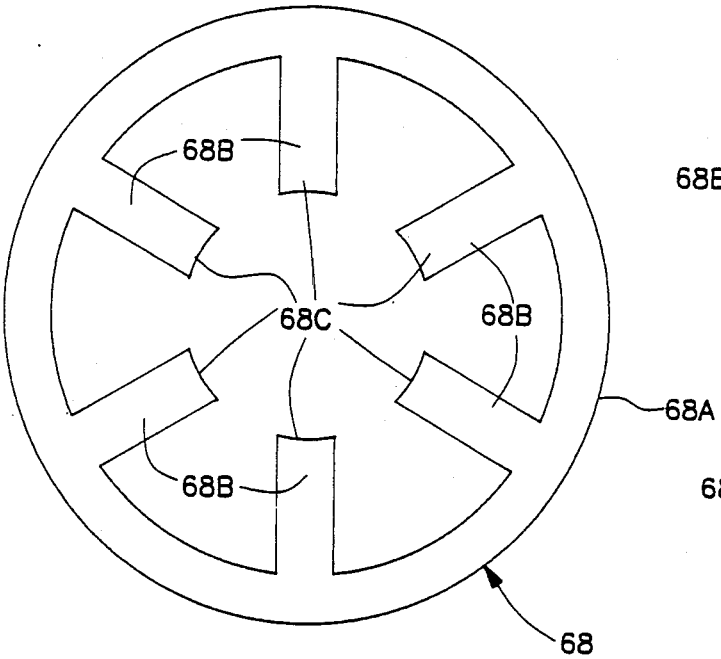
FIG. 7 is a rear elevational view of the flexure spring as seen along line 7—7 of FIG. 6.
Figure 6:
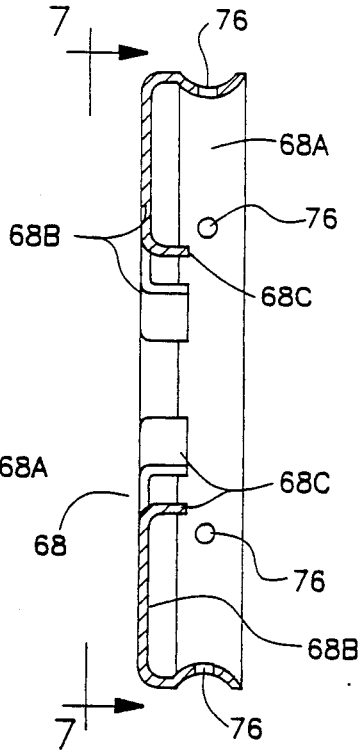
FIG. 6 is an enlarged side elevational view of a spider-like flexure spring which is the one end cap retention and retraction feature of the present invention shown located at the rearward end of the round in FIGS. 3 and 4.
Figure 9:
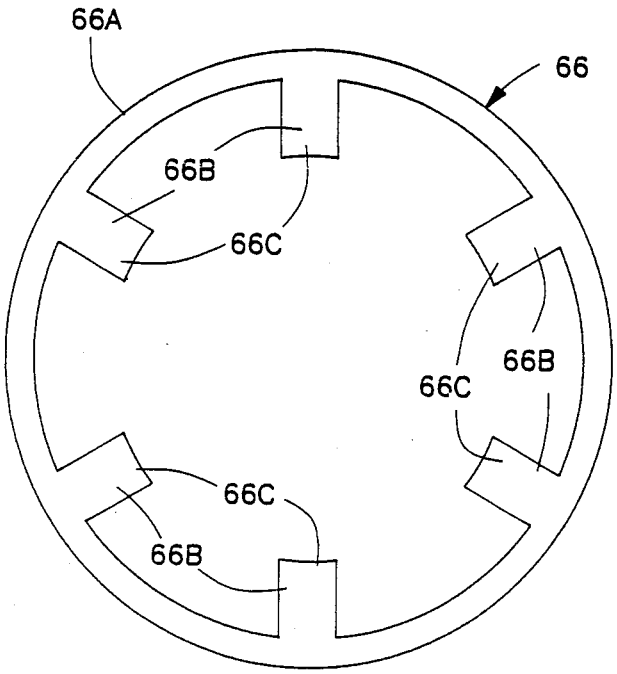
FIG. 9 is a front elevational view of the flexure spring as seen along line 9—9 of FIG. 8.
Figure 8:
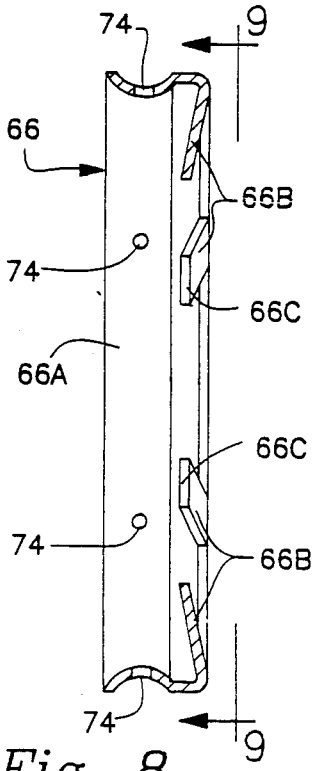
FIG. 8 is an enlarged side elevational view of another spider-like flexure spring which is the other end cap retention and retraction feature of the present invention shown located at the forward end of the round in FIGS. 3 and 5.
Figure 10:
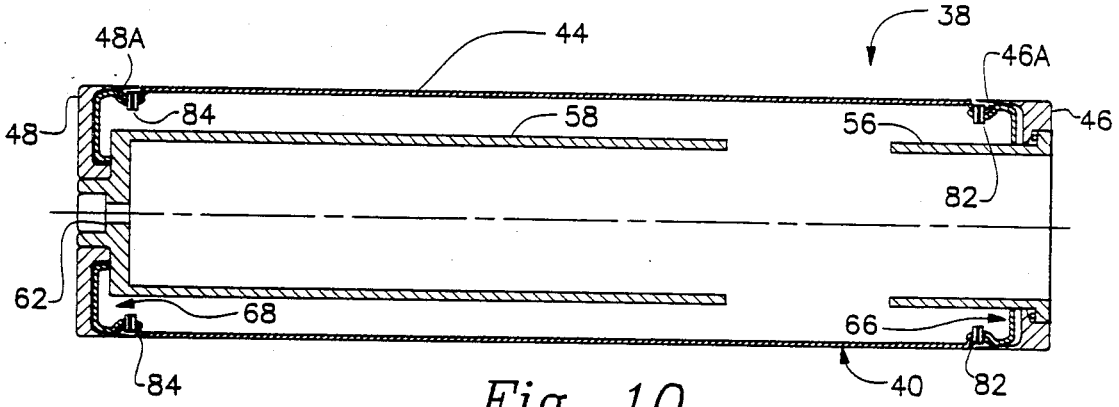
FIG. 10 is another longitudinal axial sectional view of the cased telescoped ammunition round incorporating the end cap retention and retraction features of the present invention, with the axially expanded condition of the round after firing being illustrated before return of the round to its initial relaxed condition.
Figure 11:
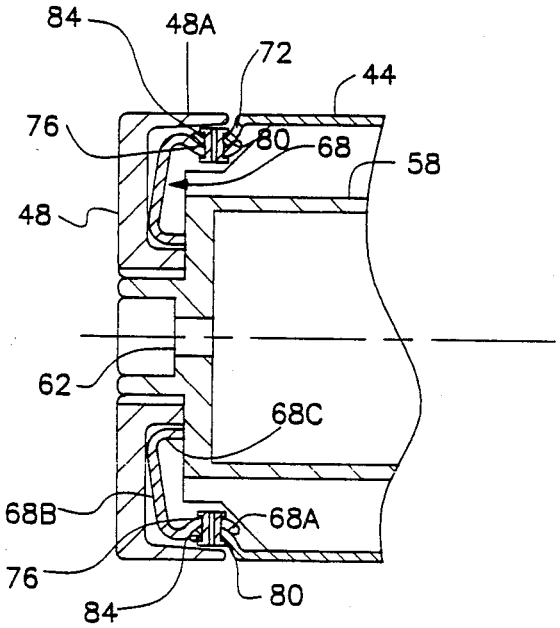
FIG. 11 is an enlarged fragmentary view of the rearward end of the round of FIG. 10, showing the flexed condition of the one end cap retention and retraction feature after firing of the round before return to its initial unflexed condition.
Figure 12:
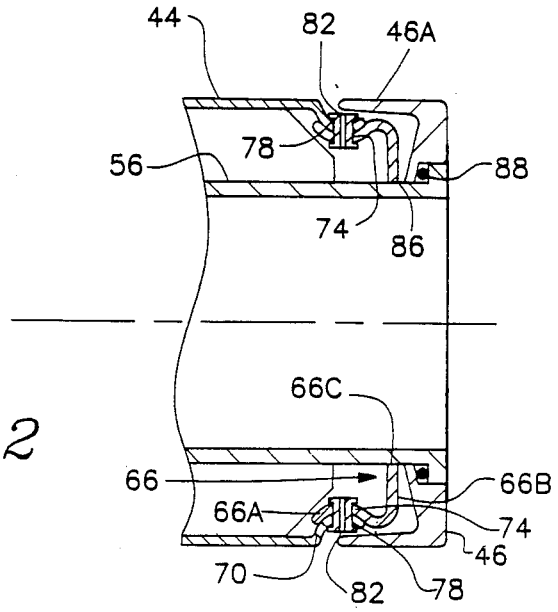
FIG. 12 is an enlarged fragmentary view of the forward end of the round of FIG. 10, showing the flexed condition of the other end cap retention and retraction feature after firing of the round.

Turning now to FIGS. 3–5, there is shown the features of the present invention associated with a cased telescoped ammunition round 38 for providing improved end cap retention during firing and end cap retraction after firing to ensure dimensional recovery of the tubular case 40 of the round after firing of a projectile therefrom so that the case can be ejected from the gun chamber.

The elongated tubular case 40 of the improved round 38 includes a case skin tube 44 and a pair of forward and aft end caps 46, 48 on opposite ends of the tube. The tubular case 40 defines a chamber 50 that contains a propellant charge 52 having an axial bore 54. Separate forward and aft tubes 56, 58 (such as a forward erosion inhibitor tube and an aft control tube) are disposed in the case 40 extending at least partially through the axial bore 54 of the propellant charge 52 from respective forward and aft ends of the bore. The separate forward and aft tubes 56, 58 are attached, such as by being threadably fastened, respectively to the forward and aft end caps 46, 48 of the case 40.

A projectile 60 spans between and is housed within the separate tubes 56, 58 and within the axial bore 54 of the propellant charge 52. A primer 62 along with loose propellant charge 64 are disposed within an aft end of the aft tube 58. The primer 62 is actuatable for igniting the loose propellant charge 64 to cause initial propulsion of the projectile 60 forwardly through the aft tube 58. Once the projectile 60 passes the forward end of the aft tube 58, the main propellant charge 52 is exposed and ignited which, in turn, causes the main firing of the projectile forwardly from the case 40 and the gun barrel (not shown).

The features of the present invention generally relate to internal forward and aft flexure springs 66, 68, each being spider-like in configuration, provided in forward and aft ends of the case 40. The flexure springs 66, 68 have slightly different configurations and are associated with the opposite forward and aft rims or ends 70, 72 of the case skin tube 44 and with the forward end of the forward tube 56 and the aft end of the aft tube 58, adjacent respective forward and aft end caps 46, 48. The flexure springs 66, 68 are capable of resiliently and yieldably flexing to provide positive end cap retention during firing and effective end cap retraction after firing of the round 38 to ensure dimensional recovery of the tubular case 40 after firing of the projectile 60 so that the case can be readily ejected from the gun chamber.

More particularly, as seen in FIGS. 6–9 in addition to FIGS. 3–5 and 10–12, the forward and aft flexure springs 66, 68 have respective outer peripheral annular ring-like base portions 66A, 68A attached by a plurality of fastening means at the interior of the respective forward and aft ends 70, 72 of the case skin tube 44. The springs 66, 68 also have respective pluralities of spring finger portions 66B, 68B connected to the respective base portions 66A, 68A and projecting radially inwardly therefrom which, at inner tips 66C, 68C thereof, are engaged with or anchored to respectively the forward end of the forward tube 56 and the aft end of the aft tube 58.

The plurality of fastening means are circumferentially spaced about the base portions 66A, 68A of the respective springs 66, 68 and the respective skin tube ends 70, 72 for rigidly attaching the same together. More particularly, the fastening means includes respective forward and aft pluralities of aligned circumferentially spaced holes 74, 76 and 78, 80 formed in the spring base portions 66A, 68A and skin tube ends 70, 72. Also, forward and aft pluralities of rivets 82, 84 extend through and fasten the forward and aft spring base portions 66A, 68A and skin tube ends 70, 72 together at the respective pluralities of holes 74, 78 and 76, 80 formed therein. The base portion 66A, 68A of each spring 66, 68 and each skin tube end 70, 72 fastened thereto are generally concave-shaped in cross-section such that the skin tube ends seat in the respective spring base portions. Further, forward and aft end caps 46, 48 has respective inner annular rims 46A, 48A which overlies the respective seated forward and aft spring base portions 66A, 68A and skin tube ends 70, 72 where the latter are fastened together by the fastening means.

The configurations of the springs 66, 68 differ from one another in the respective lengths and shapes of their spring finger portions 66B, 68B. Each spring finger portion 66A of the forward flexure spring 66 is generally linear-shaped in cross-section and its inner tip 66C is snap fitted in a groove 86 formed circumferentially about the exterior of the forward tube 56 to more or less attach or anchor the forward spring 66 to the forward tube 56. Each spring finger portion 68A of the aft flexure spring 68 is longer than each spring finger portion 66A of the forward flexure spring 66 and is generally bent inwardly away from the aft end cap 48 and toward aft end of the aft tube 58. Thus, the aft spring 68 is more or less captured between the aft end cap 48 and aft end of the aft tube 58.

In summary, therefore, the internal spider-like flexure springs 66, 68 are attached to respective forward and aft ends 70, 72 of the skin tube 44, detachably anchored to the respective forward end of the forward tube 56 and aft end of the aft tube 58, and disposed adjacent to and internally of respective forward and aft end caps 46, 48 for ensuring retention of the end caps on the skin tube ends during projectile firing. The springs 66, 68 are resiliently and yieldably flexible for allowing axial movement of the forward and aft end caps 46, 48 and their inner rims **6A, 48*a* away from the respective forward and aft skin tube ends 70, 72 during projectile firing, to the displaced positions shown in FIGS. 10–12. However, these same properties of the springs 66, 68 cause retraction of the end caps 46, 48 and their respective rims 46A, 48A back toward the respective skin tube ends 70, 72 after projectile firing, to the positions shown in FIGS. 3–5, to ensure dimensional recovery of the case 40 after such firing for facilitating ejection of the case from a gun chamber. Thus, the internal springs 66, 68 draw the end caps 46, 48 back toward their original positions, seen in FIGS. 3–5**, after firing and retain them during ejection.

Assembly of the round 10 would preferably occur in the following sequence: (1) The primer 62 is installed into the aft tube (control tube) 58. (2) Loose propellant charge 64 and the projectile 60 are installed in the aft tube 58. (3) The aft spring 66 is riveted onto the aft end of the skin tube 44. (4) The aft end cap 48 is slid over the aft skin tube end 72. (5) The aft tube/primer/loose propellant/projectile subassembly is inserted into the aft end cap/aft spring/skin tube subassembly and threaded into the aft end cap 48. (6) The aft propellant charge portion 52B is slid into the skin tube 44 over the aft tube 58, followed by the forward propellant charge portion 52B. (7) The forward spring 66 is riveted onto the forward end 70 of the skin tube 44. (8) An erosion inhibitor is placed into the bore 54 in the forward propellant charge portion 52A. (9) The forward end cap 46 is placed over the forward end 70 of the skin tube 44. (10) A tolerance seal 88 is slid onto the forward tube (erosion inhibitor tube) 56. (11) The forward tube 56 is inserted into the bore 54 of the forward propellant charge portion 52A and is pushed in until the forward spring finger portions 66B snap into the annular groove 86 in the exterior of the forward tube 56. (12) Finally, the seams and exit port of the forward end cap 46 are sealed.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

Having thus described the invention, what is claimed is:

1. In a cased telescoped ammunition round, the combination comprising:

(a) an elongated propellant charge having an axial bore therethrough;

(b) an elongated tubular case composed of a skin tube and forward and aft end caps on opposite forward and aft ends of said tube, said case defining a chamber that contains said propellant charge;

(c) tubular means disposed in said case extending at least partially through said axial bore of said propellant charge from forward and aft ends thereof and attached respectively to said forward and aft end caps of said case;

(d) a projectile housed within said tubular means and in said axial bore of said propellant charge;

(e) a primer positioned within said aft end of said tubular means and being actuatable for igniting said propellant charge to cause firing of said projectile forwardly from said case; and (f) an internal flexure spring engaged with at least one of said forward and aft ends of said tubular means, attached to at least the corresponding one of said forward and aft ends of said skin tube and disposed adjacent to and internally of the corresponding one of said forward and aft end caps for ensuring retention of said one end cap on said one skin tube end during projectile firing, said spring being resiliently and yieldably flexible for allowing axial movement of said one end cap away from said one skin tube end during projectile firing but causing retraction of said one end cap back toward said one skin tube end after projectile firing to ensure dimensional recovery of said case after such firing for facilitating ejection of said case from a gun chamber.

2. The ammunition round of claim 1, wherein said spring is spider-like in configuration.

3. The ammunition round of claim 1, wherein said spring has an outer peripheral annular ring-like base portion attached to said one skin tube end at the interior thereof.

4. The ammunition round of claim 3, further comprising a plurality of fastening means circumferentially spaced about said spring base portion and said one skin tube end and rigidly attaching the same together.

5. The ammunition round of claim 4, wherein said fastening means includes respective pluralities of circumferentially spaced holes formed in said spring base portion and said one skin tube end.

6. The ammunition round of claim 5, wherein said fastening means further includes a plurality of rivets extending through and fastening said spring base portion and said one skin tube end together at said respective pluralities of holes formed therein.

7. The ammunition round of claim 3, wherein said one end cap has an inner annular rim which overlies said spring base portion and said one skin tube end where they are fastened together by said fastening means.

8. The ammunition round of claim 3, wherein said spring base portion and skin tube end are generally concave-shaped in cross-section and disposed together in a seated relationship.

9. The ammunition round of claim 3, wherein said spring also has a plurality of spring finger portions connected to said base portion and projecting radially inwardly therefrom which, at inner tips thereof, are anchored to the corresponding one of said forward and aft ends of said tubular means.

10. The ammunition round of claim 9, wherein said each spring finger portion is generally linear-shaped in cross-section.

11. The ammunition round of claim 9, wherein said inner tip of each spring finger portion is generally bent inwardly away from said one end cap and toward said one end of said tubular means.

12. In a cased telescoped ammunition round, the combination comprising:

(a) an elongated propellant charge having an axial bore therethrough;

(b) an elongated tubular case composed of a skin tube and forward and aft end caps on opposite forward and aft ends of said tube, said case defining a chamber that contains said propellant charge;

(c) separate forward and aft tubes disposed in said case extending at least partially through said axial bore of said propellant charge from forward and aft ends thereof and attached respectively to said forward and aft end caps of said case;

(d) a projectile spanning between and housed within said separate tubes and in said axial bore of said propellant charge;

(e) a primer positioned within said aft end of said aft tube and being actuatable for igniting said propellant charge to cause firing of said projectile forwardly from said case; and (f) internal flexure springs engaged respectively with said forward end of said forward tube and said aft end of said aft tube, attached respectively to said forward and aft ends of said skin tube and disposed respectively adjacent to and internally of said forward and aft end caps for ensuring retention of said end caps on said respective skin tube ends during projectile firing, said springs being resiliently and yieldably flexible for allowing axial movement of said end caps away from said respective skin tube ends during projectile firing but causing retraction of said end caps back toward said respective skin tube ends after projectile firing to ensure dimensional recovery of said case after such firing for facilitating ejection of said case from a gun chamber.

13. The ammunition round of claim 12, wherein each of said springs is spider-like in configuration.

14. The ammunition round of claim 12, wherein each of said springs has an outer peripheral annular ring-like base portion attached to the respective one of said skin tube ends at the interior thereof.

15. The ammunition round of claim 14, further comprising a plurality of fastening means circumferentially spaced about said spring base portion of each of said springs and said respective one skin tube end and rigidly attaching the same together.

16. The ammunition round of claim 15, wherein said fastening means includes respective pluralities of circumferentially spaced holes formed in each of said spring base portions and said respective one skin tube end.

17. The ammunition round of claim 16, wherein said fastening means further includes a plurality of rivets extending through and fastening said each spring base portion and said respective one skin tube end together at said respective pluralities of holes formed therein.

18. The ammunition round of claim 15, wherein said each of said end caps has an inner annular rim which overlies said respective spring base portion and one skin tube end where they are fastened together by said fastening means.

19. The ammunition round of claim 15, wherein said each spring base portion and skin tube end are generally concave-shaped in cross-section and disposed together in a seated relationship.

20. The ammunition round of claim 15, wherein said each spring also has a plurality of spring finger portions connected to said base portion of said spring and projecting radially inwardly therefrom which, at inner tips thereof, are anchored to the respective one of said forward end of said forward tube and aft end of said aft tube.

21. The ammunition round of claim 20, wherein said each spring finger portion of said forward spring is generally planar-shaped in cross-section.

22. The ammunition round of claim 20, wherein said inner tip of each spring finger portion of said aft spring is generally bent inwardly away from said aft end cap and toward said aft end of said aft tube.

* * * * *